US011445587B2

(12) United States Patent
Greenwood

(10) Patent No.: US 11,445,587 B2
(45) **Date of Patent: *Sep. 13, 2022**

(54) POWER CONVERTER WITH CURRENT MATCHING

(71) Applicant: Power Integrations, Inc., San Jose, CA (US)

(72) Inventor: John David Greenwood, Bassingbourn (GB)

(73) Assignee: Power Integrations, Inc., San Jose, CA (US)

( * ) Notice: Subject to any disclaimer, the term of this patent is extended or adjusted under 35 U.S.C. 154(b) by 84 days.

This patent is subject to a terminal disclaimer.

(21) Appl. No.: 17/090,833

(22) Filed: Nov. 5, 2020

(65) Prior Publication Data

US 2021/0059028 A1 Feb. 25, 2021

Related U.S. Application Data

(63) Continuation of application No. 16/433,584, filed on Jun. 6, 2019, now Pat. No. 10,863,600.

(60) Provisional application No. 62/687,001, filed on Jun. 19, 2018.

(51) Int. Cl.

| | |
|---|---|
| ***H05B 45/397*** | (2020.01) |
| ***H05B 45/10*** | (2020.01) |
| ***H05B 45/35*** | (2020.01) |
| ***H05B 45/382*** | (2020.01) |

(52) U.S. Cl.

CPC ..... *H05B 45/397* (2020.01); *H05B 45/10* (2020.01); *H05B 45/35* (2020.01); *H05B 45/382* (2020.01)

(58) Field of Classification Search

CPC .. H05B 37/0263; H05B 45/397; H05B 45/10; H05B 45/35; H05B 45/382; H05B 45/14; H05B 45/46; Y02B 20/30; G09G 3/3406; G09G 3/3413

USPC ..... 315/186

See application file for complete search history.

(56) References Cited

U.S. PATENT DOCUMENTS

| | | | | |
|---|---|---|---|---|
| 5,038,053 | A | 8/1991 | Djenguerian et al. | |
| 6,028,592 | A | 2/2000 | Umeda et al. | |
| 8,805,550 | B2 * | 8/2014 | Chemel | H05B 47/155 700/297 |
| 10,277,136 | B2 | 4/2019 | Werner et al. | |
| 10,344,954 | B1 * | 7/2019 | Tischler | H01R 13/2492 |
| 2004/0227472 | A1 * | 11/2004 | Gaus, Jr. | H05B 47/185 315/320 |
| 2005/0242822 | A1 | 11/2005 | Klinger | |

(Continued)

*Primary Examiner* — Don P Le

(74) *Attorney, Agent, or Firm* — Power Integrations, Inc.

(57) ABSTRACT

A current matching circuit includes a plurality of LED driver circuits. A current to voltage converter circuit is coupled to the plurality of LED driver circuits to generate a plurality of voltage signals. Each one of the plurality of voltage signals is representative of a respective output current through a corresponding one of the plurality of LED driver circuits. A comparison circuit is coupled to the current to voltage converter circuit to compare the plurality of voltage signals. An adjustment circuit is coupled to the comparison circuit and the plurality of LED driver circuits. The adjustment circuit is configured to trim the plurality of LED driver circuits in response to the comparison circuit such that each respective output current through the plurality of LED driver circuits is substantially equal.

12 Claims, 10 Drawing Sheets

(56) References Cited

U.S. PATENT DOCUMENTS

| | | | | |
|---|---|---|---|---|
| 2009/0289578 | A1* | 11/2009 | Peng | H05B 47/18 315/294 |
| 2010/0052552 | A1 | 3/2010 | Kimura | |
| 2012/0242230 | A1 | 9/2012 | Jin | |
| 2014/0152180 | A1 | 6/2014 | Wolf et al. | |
| 2014/0333204 | A1 | 11/2014 | Zhang et al. | |
| 2015/0061528 | A1 | 3/2015 | Raval et al. | |
| 2015/0115809 | A1* | 4/2015 | Siessegger | H05B 47/185 315/291 |
| 2015/0115830 | A1* | 4/2015 | Siessegger | H05B 45/395 315/291 |
| 2015/0351194 | A1* | 12/2015 | Sung | H05B 47/18 315/153 |
| 2016/0081160 | A1* | 3/2016 | Vangeel | H05B 47/155 315/293 |
| 2016/0143096 | A1 | 5/2016 | Lin et al. | |
| 2016/0174333 | A1* | 6/2016 | Kim | H05B 47/195 250/338.1 |
| 2016/0226373 | A1 | 8/2016 | Pamato et al. | |
| 2017/0175987 | A1* | 6/2017 | Newton | F21V 23/0442 |
| 2018/0219582 | A1* | 8/2018 | Scott | H04B 3/546 |
| 2019/0293557 | A1 | 9/2019 | Sato et al. | |

* cited by examiner

POWER CONVERTER WITH CURRENT MATCHING

CROSS-REFERENCE TO RELATED APPLICATIONS

This application is a continuation of U.S. patent application Ser. No. 16/433,584, filed on Jun. 6, 2019, which claims benefit of U.S. Provisional Application No. 62/687,001 filed on Jun. 19, 2018, the contents are hereby incorporated by reference in its entirety.

BACKGROUND INFORMATION

Field of the Disclosure

The present invention relates generally to current matching circuits, and more specifically a power converter including circuitry that drives a plurality of matched currents.

Background

Many display panel technologies such as monitors and televisions require backlighting provided by a light source. Multiple strings of white light emitting diodes (LEDs) are sometimes used to provide the backlighting for such displays. The LED strings can come in the form of multiple low voltage or single higher voltage LED strings. The requirements for the backlights are broad, requiring support of different multiple strings, differing string lengths, different voltages with different maximum LED currents, and the ability to be dimmed via direct pulse width modulation of the outputs, or via direct current (dc) dimming.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
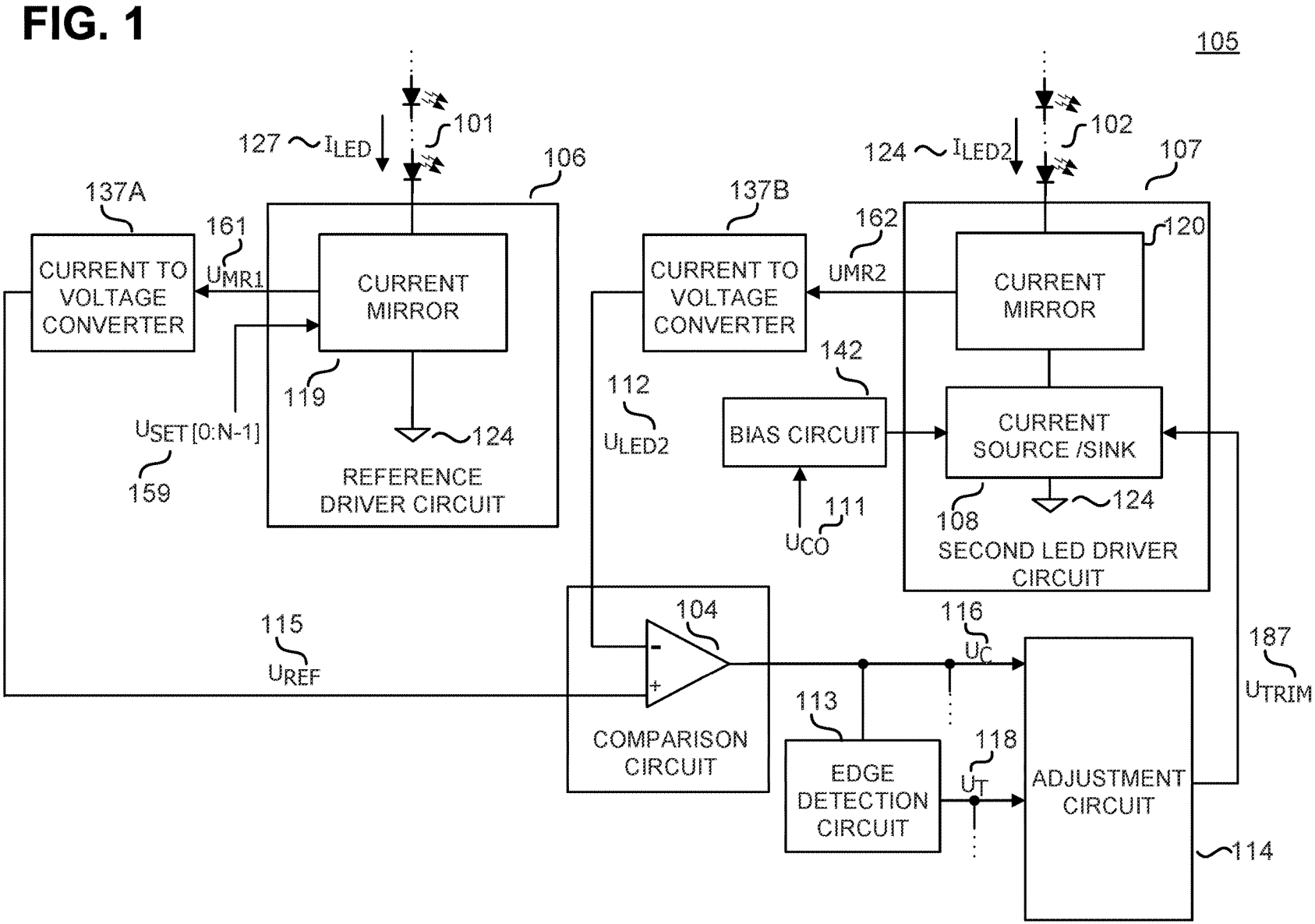
FIG. 1 is a block diagram illustrating one example of a current matching circuit in accordance with the teachings of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

Examples of a current matching circuits included in a power converter are described herein. In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment," "an embodiment," "one example," or "an example" means that a particular feature, structure or characteristic described in connection with the embodiment or example is included in at least one embodiment of the present invention. Thus, appearances of the phrases "in one embodiment," "in an embodiment," "one example," or "an example" in various places throughout this specification are not necessarily all referring to the same embodiment or example. Furthermore, the particular features, structures or characteristics may be combined in any suitable combinations and/or subcombinations in one or more embodiments or examples. Particular features, structures or characteristics may be included in an integrated circuit, an electronic circuit, a combinational logic circuit, or other suitable components that provide the described functionality. In addition, it is appreciated that the figures provided herewith are for explanation purposes to persons ordinarily skilled in the art and that the drawings are not necessarily drawn to scale.

An example of a current matching circuit that can calibrate multiple current loads with a reference current load is described herein. In a power converter, a power converter controller can regulate an output characteristic to a load such as current or voltage. In one example, the current matching circuit can be used for a plurality of LED (light emitting diode) drivers. In another example, the current matching circuit can be used for a plurality of drivers for a different application. A power converter can provide an output voltage to a load such as a LED string. In an ideal case, the forward voltage of each LED string is the same, and the currents in each LED string will also be the same. However, the non-idealities of an LED string can cause the forward voltage drops across the LEDs of the LED string to vary, which can therefore cause the current through the LED strings to vary as well. For applications that use LED strings for backlighting such as computer displays, a mismatch in currents of the individual LED strings can produce a non uniformities in the brightness of the backlight. In order to improve uniform backlighting for a display, the current in LED strings that provide the backlighting should be matched as closely as possible relative to each other. In other words, although the non-idealities of each LED string can vary, so long as the current of each LED string is within a certain tolerance or percentage, the brightness of the LED strings can appear the same throughout the display. In one example, the currents of the LED strings should match each other within 2-3% or less.

In one example, the currents through the LED strings can be calibrated to be relatively matched during a test or trimming phase. A current through a first LED string can be used as the reference current in order to calibrate the currents through the other LED strings in the display to be substantially equal to provide uniform backlighting. To illustrate, FIG. 1 is a block diagram illustrating one example of a current matching circuit 105 in accordance with the teachings of the present invention. As shown in the depicted example, current matching circuit 105 includes a plurality of LED driver circuits, including a reference driver circuit 106 and a second LED driver circuit 107. The reference driver circuit 106 can also be referred to as the first LED driver circuit. In one example, the first LED driver circuit 106 is configured to drive a reference current $I_{LED}$ 127 through an LED string 101 and the second LED driver circuit 107 is configured to drive a second current $I_{LED2}$ 124 through an LED string 102. As such, first LED driver circuit 106 can also be labeled reference LED driver circuit 106, and second LED driver circuit 107 can also be referred to as second driver circuit 107 in FIG. 1. In other examples, it is appreciated that there may be more additional LED strings with a corresponding driver circuit.

In the illustrated example, a current to voltage converter circuit, including current to voltage converter 137A and current to voltage converter 137B are coupled to the plurality of LED driver circuits 106 and 107 to generate a plurality of voltage signals $U_{REF}$ 115 and $U_{LED2}$ 112, respectively. In the example, each one of the plurality of voltage signals $U_{REF}$ 115 and $U_{LED2}$ 112 is representative of a respective output current, $I_{LED}$ 127 and $I_{LED2}$ 124 through a corresponding one of the plurality of LED driver circuits 106 and 107. In the example, voltage signal $U_{REF}$ 115 is a reference voltage signal that is representative of a reference output current, which is illustrated as the output current $I_{LED}$ 127 through the first LED driver circuit 106, and the voltage signal $U_{LED2}$ 112 is a second voltage signal that is representative of a second output current, which is illustrated the output current $I_{LED2}$ 124 through the second LED driver circuit 107.

A comparison circuit 104 is coupled to the current to voltage converter 137A and 137B and is configured to compare the plurality of voltage signals $U_{REF}$ 115 and $U_{LED2}$ 112. As shown in the depicted example, an adjustment circuit 114 is coupled to the comparison circuit 104 and the second LED driver circuit 107 of the plurality of LED driver circuits. In the depicted example, the adjustment circuit 114 is configured to trim the second LED driver circuit 107 of the plurality of LED driver circuits in response to the comparison circuit 104 such that each respective output currents $I_{LED}$ 127 and $I_{LED2}$ 124 through the plurality of LED driver circuits 106 and 107 is substantially equal.

In the illustrated example, first LED driver circuit 106 includes a current mirror 119 coupled to a local return 124. Current mirror 119 is configured to be set in response to a set signal $U_{SET}$ 159. The set signal $U_{SET}$ 159 can be a multi-bit signal that determines how much to adjust the gain of current mirror 119. Current mirror 119 is configured to drive output current $I_{LED}$ 127, and is configured to output a current mirror signal $U_{MR1}$ 161 to current to voltage converter 137A.

Second driver circuit 107 includes a current mirror 120 coupled to a combined current source/sink 108, which is coupled to local return 124. Current source/sink 108 is configured to be adjusted in response to a trim signal $U_{TRIM}$ 187 received from the adjustment circuit 114. Current mirror 120 is configured to drive output current $I_{LED2}$ 124, and is configured to output a current mirror signal $U_{MR2}$ 162 to current to voltage converter 137B.

In one example, comparison circuit 104 is coupled to output a calibrate signal $U_C$ 116 in response to a comparison of voltage signal $U_{REF}$ 115 and voltage signal $U_{LED2}$ 112. An edge detection circuit 113 is coupled to the comparison circuit 104. The edge detection circuit 113 is configured to generate a transition signal $U_T$ 118 when the comparison circuit 104 transitions from a first state to a second state. In one example, the edge detection circuit 113 can be included in the adjustment circuit 114. In FIG. 1, the edge detection circuit 113 is shown outside the adjustment circuit 114 for illustrative purposes. In other examples, the edge detection circuit 113 could be a part of the adjustment circuit 114.

In operation, comparison circuit 104 receives the voltage signal $U_{LED2}$ 112 at the inverting terminal and receives the voltage signal $U_{REF}$ 115 at the non-inverting terminal. The comparison circuit 104 determines if the voltage signal $U_{REF}$ 115 is greater than the voltage signal $U_{LED2}$ 112 to generate the calibrate signal $U_C$ 116.

In one example, if the voltage signal $U_{REF}$ 115 is greater than the voltage signal $U_{LED2}$ 112, the first state of the comparison circuit 104 can be a logic high. The edge detection circuit 113 can determine when the comparison circuit 104 transitions from the first state to a second state when the comparison circuit 104 transitions from a logic high to a logic low. The edge detection circuit 113 generates a transition signal $U_T$ 118 in response to the comparison circuit 104 transitioning from the first state to the second state. The transition signal $U_T$ 118 indicates the voltage signal $U_{REF}$ 115 is not greater than the voltage signal $U_{LED2}$ 112.

In another example, if the voltage signal $U_{REF}$ 115 is less than the voltage signal $U_{LED2}$ 112, the first state of the comparison circuit 104 can be a logic low. The edge detection circuit 113 can determine when the comparison circuit 104 transitions from the first state to a second state when the comparison circuit 104 transitions from a logic low to a logic high. The edge detection circuit 113 generates a transition signal $U_T$ 118 in response to the comparison circuit 104 transitioning from the first state to the second state. This indicates the voltage signal $U_{REF}$ 115 is not below the voltage signal $U_{LED2}$ 112.

It is appreciated that in other examples a current comparator could be used instead to compare the output currents $I_{LED}$ 127 and $I_{LED2}$ 124, and the current to voltage converter 137A and 137B may not be necessary. It is appreciated that if comparison circuit 104 does not transition states, the selected range of the current source/sink 108 is unable to calibrate the two LED strings. In this example, a bias circuit 142 can be included to increase the profile of ranges for adjusting the current source/sink. In other examples, the bias circuit 142 can be optional. The bias circuit 142 can be controlled with a configuration signal $U_{CO}$ 111.

In the depicted example, the adjustment circuit 114 receives the calibration signal $U_C$ 116, the transition signal $U_T$ 118, and generates the trim signal $U_{TRIM}$ 187. In the illustrated example, the trim signal $U_{TRIM}$ 187 is configured to adjust the current source/sink 108, that is included in the second LED driver circuit 107, in response to the comparison circuit 104 until the output current $I_{LED}$ 127 and the output current $I_{LED2}$ 124 match. In other examples, the calibration signal $U_C$ 116, the transition signal $U_T$ 118 can be monitored externally for example by a production tester circuit as will be shown in FIG. 2.

In other examples, there may be more than two LED strings to match relative to each other. In this case, the adjustment circuit can select the additional string or strings to be matched to the same current as the current to voltage converter and comparison circuit, which can eliminate any contribution for LED string mismatch since they are in common. The adjustment circuit in incremental steps may address each of the plurality of LED driver circuits with respect to the reference output current until all of the output currents of the LED strings are substantially equal.

Figure 2:
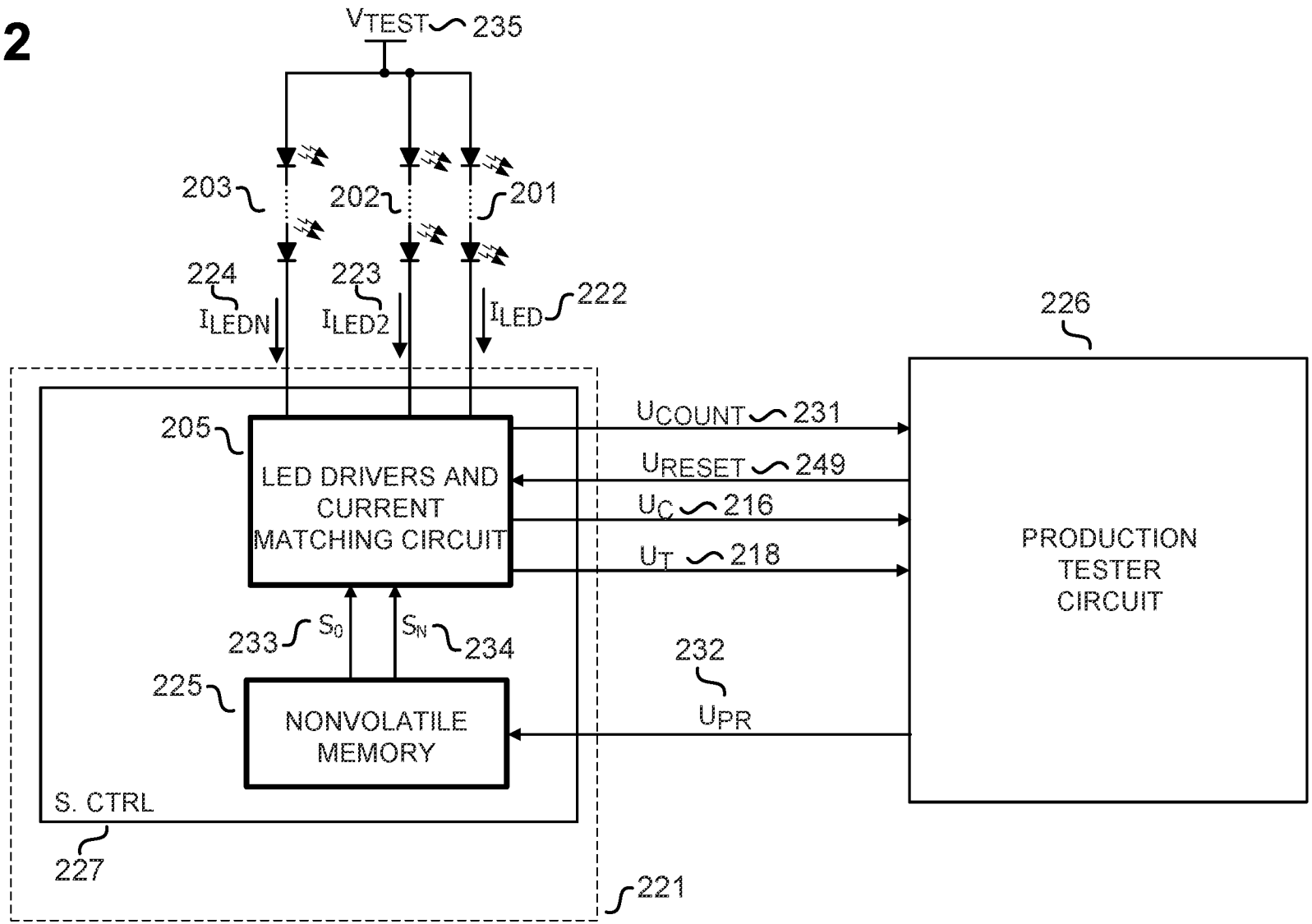
FIG. 2 is a block diagram illustrating one example of a power converter controller including an example current matching circuit in accordance with the teachings of the present invention.

FIG. 2 is a block diagram illustrating one example of a power converter controller 221 including an example current matching circuit 205 in accordance with the teachings of the present invention. It is noted that the current matching circuit 205 of FIG. 2 may be one example of the current matching circuit 105 of FIG. 1, and that similarly named and numbered elements referenced below are coupled and function similar to as described above. As shown in the example depicted in FIG. 2, power converter controller 221 includes a secondary control circuit 227. The secondary control circuit 227 is configured to drive a plurality of loads, including loads 201, 202, and load 203. The loads 201, 202 and 203 are supplied with a test voltage $V_{TEST}$ 235. In one example, loads 201, 202, and 203 are LED strings through which output currents $I_{LED}$ 222, $I_{LED2}$ 223, and $I_{LEDN}$ 224 are driven to provide uniform backlighting for a display. In one example, the secondary control circuit 227 includes current matching circuit 205 coupled to nonvolatile memory 225 to receive a plurality of select signals $S_0$ 233 to $S_N$ 234.

In one example, a production tester circuit 226 is coupled to the secondary control circuit 227 to test and calibrate the output currents $I_{LED}$ 222, $I_{LED2}$ 223, and $I_{LEDN}$ 224 that are driven through the LED strings, or the loads 201, 202, and 203 during a testing and calibration phase. In one example, LED string 201 can be referred to as the reference LED string such that the LED string 202 and LED string 203 are calibrated with respect to LED string 201. It is appreciated that in other examples, LED string 202 or LED string 203 could be the reference LED string. In one example, the production tester circuit 226 is configured to receive a calibration signal $U_C$ 216, a transition signal $U_T$ 18, and a count signal $U_{COUNT}$ 231, from current matching circuit 205 and the production tester circuit 226 generates a reset signal $U_{RESET}$ 249 and a corresponding programming signal $U_{PR}$ 232 in response to the count signal $U_{COUNT}$ 231 to store the plurality of select signals $S_0$ 233 to $S_N$ 234 in nonvolatile memory 225. It is appreciated that although the count signal $U_{COUNT}$ 231, reset signal $U_{RESET}$ 249, calibration signal $U_C$ 216, transition signal $U_T$ 18 are shown as distinct signal lines, these signal lines can be coupled to the current matching circuit 205 over a serial bus interface.

In one example of operation, the production tester circuit 226 can monitor when the current of LED string 201 matches the LED string 202. Before calibration begins, a counter circuit within current matching circuit 205 is reset by reset signal $U_{RESET}$ 249. To determine if the currents of LED string 201 and LED string 202 are the same, the current matching 205 circuit outputs a calibration signal $U_C$ 216. The calibration signal $U_C$ 216 can be referred to as a sign bit to indicate if the LED string 202 is above or below the reference LED string 201. The count signal $U_{COUNT}$ 231 continuously counts up and is monitored by the production tester circuit 226. When the transition signal $U_T$ 18 is generated, the count signal $U_{COUNT}$ 231 is stored by the production tester circuit 226. To calibrate the reference LED string 201 to LED string 203, the counter within the current matching circuit 205 is again reset by reset signal $U_{RESET}$ 249. In one example, the count signal $U_{COUNT}$ 231 can be programmed by a program signal $U_{PR}$ 232 into nonvolatile memory 225 after each transition signal $U_T$ 31 has been received. In other examples, the multiple count signals can be programmed once all the LED strings have been calibrated.

In one example, the plurality of select signals $S_0$ 233 to SN 234 is generated in response to the programming signal $U_{PR}$ 232. As will be discussed in greater detail below, a register circuit (not shown in FIG. 2) is included in current matching circuit 205 and is configured to receive the plurality of select signals $S_0$ 233 to $S_N$ 234 from a nonvolatile memory 225. In one example, the count values that are stored in nonvolatile memory 225 are used for trimming the plurality of LED driver circuits included in current matching circuit 205 such that each respective output current $I_{LED}$ 222, $I_{LED2}$ 223, and $I_{LEDN}$ 224 through the plurality of LED strings 201, 202, and 203 is substantially equal in accordance with the teachings of the present invention.

Figure 3:
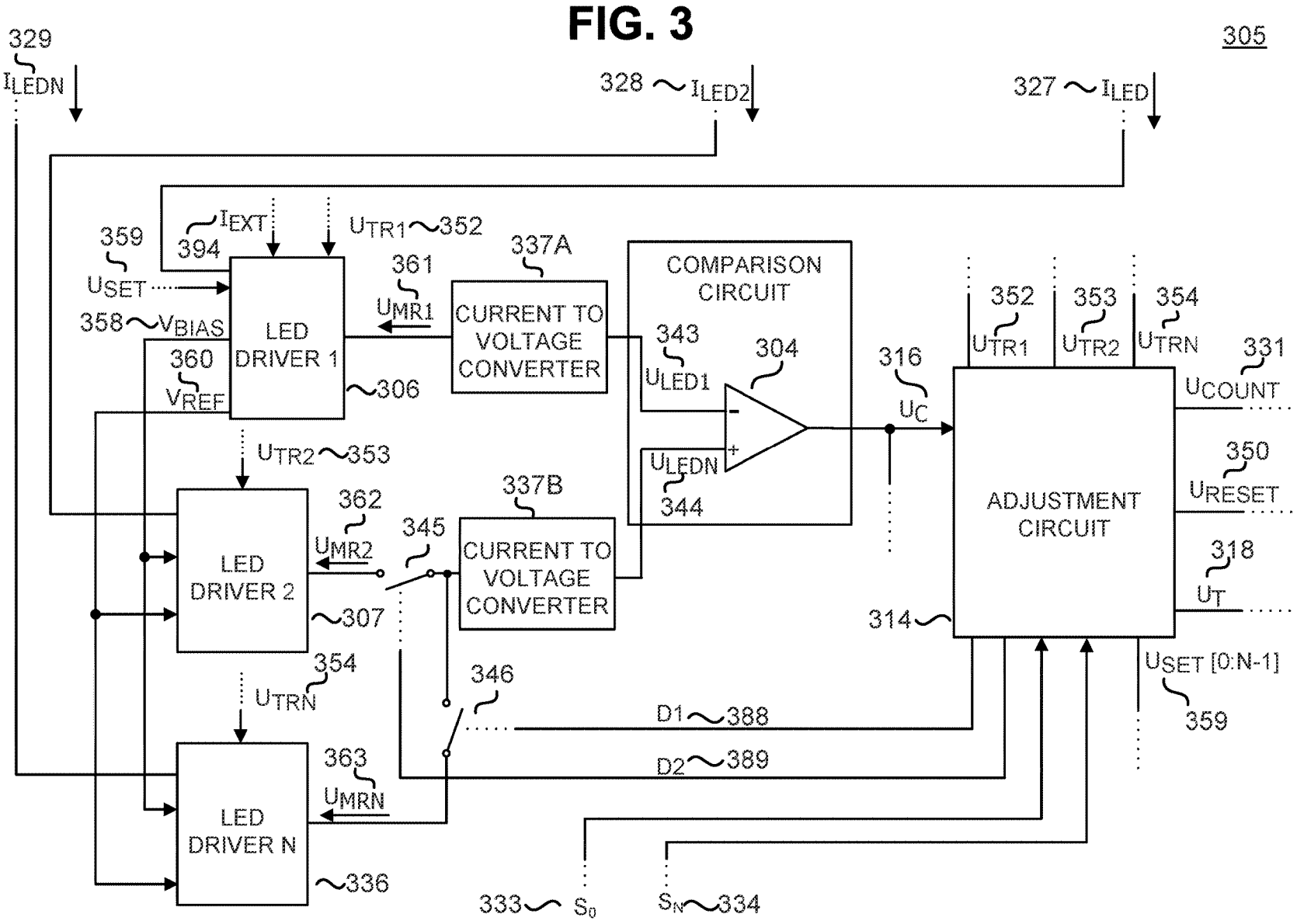
FIG. 3 is a block diagram illustrating another example of a current matching circuit in accordance with the teachings of the present invention.

FIG. 3 is a block diagram illustrating another example of a current matching circuit 305 in accordance with the teachings of the present invention. It is noted that the current matching circuit 305 of FIG. 3 may be one example of the current matching circuit 105 of FIG. 1 or of the current matching circuit 205 of FIG. 2, and that similarly named and numbered elements referenced below are coupled and function similar to as described above. As shown in the example depicted in FIG. 3, current matching circuit 305 includes a plurality of LED driver circuits, which are labeled LED driver 1 306, LED driver 2 307, and LED driver N 336 in FIG. 3. The N in driver N 336 is representative of the number of LED driver circuits and LED string. Each one of the plurality of LED driver circuits is configured to drive a respective output current $I_{LED}$ 327, $I_{LED2}$ 328, and $I_{LEDN}$ 329.

A current to voltage converter circuit, including current to voltage converter circuit 337A and current to voltage converter 337B, is coupled to the plurality of LED driver circuits LED driver 1 306, LED driver 2 307, and LED driver N 336 to generate a plurality of voltage signals $U_{LED1}$ 343 to $U_{LEDN}$ 344. Each one of the plurality of voltage signals $U_{LED1}$ 343 to $U_{LEDN}$ 344 is representative of a respective output current $I_{LED}$ 327, $I_{LED2}$ 328, and $I_{LEDN}$ 329 through the corresponding one of the plurality of LED driver circuits driver 1 306, LED driver 2 307, and driver N 336.

A comparison circuit 304 is coupled to the current to voltage converter circuit 337A and 337B and is configured to compare the plurality of voltage signals $U_{LED1}$ 343 to $U_{LEDN}$ 344. In the example illustrated in FIG. 3, current to voltage converter circuit 337A is configured to generate the reference voltage signal $U_{LED1}$ 343 in response to the current mirror signal $U_{MR1}$ 361, which is coupled to LED driver 1 306. In other examples, LED driver 1 306 can be referred to as first driver circuit 306.

In the example depicted in FIG. 3, an adjustment circuit 314 includes a selection circuit, which includes a switch 345 and a switch 346 that are coupled to current to voltage converter 337B to select which one of the second and third voltage signals $U_{LED2}$ (not shown) or $U_{LEDN}$ 344 is to be generated by current to voltage converter 337B to be compared to the reference voltage signal $U_{LED1}$ 343. In the depicted example, adjustment circuit 314 generates switch control signals D1 388 and D2 389 to control which one of switches 345 or 346 is closed. In the example, only one of the switches 345 or 346 is closed at a time. If switch 345 is closed, current to voltage converter 337B is configured to provide current mirror signal $U_{MR2}$ 362 to LED Driver 2 307. If switch 346 is closed, current to voltage converter 337B is configured to provide current mirror signal $U_{MRN}$ 363 to LED driver N 336. In this case, the current to voltage converter 337B is configured to generate the voltage signal $U_{LEDN}$ 344 to comparison circuit 304 for comparison with reference voltage signal $U_{LED1}$ 343.

In the depicted example, the adjustment circuit 314 is coupled to the comparison circuit 304 and receives the calibration signal $U_C$ 316. In addition, the adjustment circuit 314 is also configured to receive a plurality of select signals $S_0$ 333 to $S_N$ 334 from nonvolatile memory, as was discussed in FIG. 2. In the depicted example, the adjustment circuit 314 is configured to generate a count signal $U_{COUNT}$ 331, a transition signal $U_T$ 318, a reset signal $U_{RESET}$ 350, a set signal $U_{SET}$ 359, which is configured to be received by driver circuit 1 306, and a plurality of trim signals, including trim signal $U_{TR1}$ 352, trim signal $U_{TR2}$ 353, and trim signal $U_{TRN}$ 354. In one example, reset signal $U_{RESET}$ 350 may be asserted to initialize a starting value at the beginning of each calibration operation prior to determining the count value for count signal $U_{COUNT}$ 331. In operation, the adjustment circuit 314 is configured to trim the plurality of LED driver circuits driver 1 306, LED driver 2 307, and driver N 336 with trim signal $U_{TR1}$ 352, trim signal $U_{TR2}$ 353, and trim signal $U_{TRN}$ 354 in response to the comparison circuit 304 such that each respective output current $I_{LED}$ 327, $I_{LED2}$ 328, and $I_{LEDN}$ 329 through the corresponding one of the plurality of LED driver circuits, LED driver 1 306, LED driver 2 307, and driver N 336 is substantially equal after the calibration phase.

Figure 4:
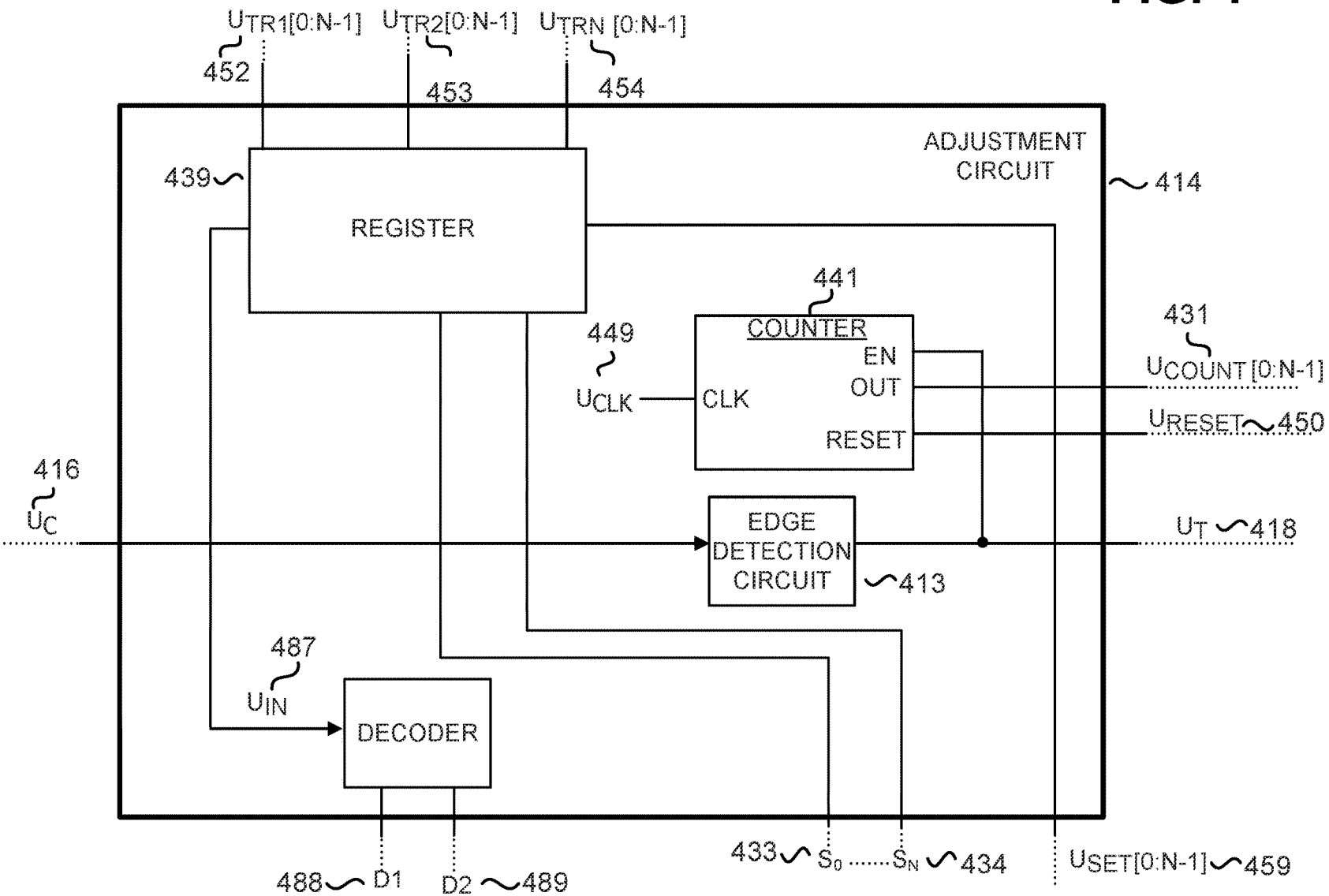
FIG. 4 is a block diagram illustrating an example of an adjustment circuit in accordance with the teachings of the present invention.

FIG. 4 is a block diagram illustrating one example of an adjustment circuit 414 included in a current matching circuit in accordance with the teachings of the present invention. It is noted that the adjustment circuit 414 of FIG. 4 may be one example of the adjustment circuit 314 of FIG. 3 or another example of the adjustment circuit 114 of FIG. 1, and that similarly named and numbered elements referenced below are coupled and function similar to as described above. As shown in the depicted example, adjustment circuit 414 includes a register 439 configured to receive a plurality of select signals $S_0$ 433 to $S_N$ 434 from a nonvolatile memory, as described for example in FIG. 2. In operation, register 439 outputs a select signal $U_{IN}$ 487 to a decoder 438, which generates the switch control signals D1 488 and D2 489 that may be used to control which switches (e.g., switch 345 or switch 346) of the select circuit are opened and closed, as discussed above in FIG. 3.

Register 439 is further configured to output a plurality of trim signals, including trim signal $U_{TR1}$ 452, trim signal $U_{TR2}$ 453, and trim signal $U_{TRN}$ 454, where the first trim signal $U_{TR1}$ 452 corresponds to a first LED string driven by a first driver, the second trim signal $U_{TR2}$ 453 corresponds to a second LED string driven by a second driver, and the trim signal $U_{TRN}$ 454 corresponds to an Nth LED string driven by an Nth driver. As mentioned previously, the nonvolatile memory of the secondary controller, as discussed for example in FIG. 2, can provide information to register 439 with the appropriate settings to calibrate each LED string. The register 439 is configured to receive the select signals $S_0$ 433 to $S_N$ 434 in order to store the trim signal values $U_{TR1}$ 452, $U_{TR2}$ 453, and $U_{TRN}$ 454. The register 439 is further configured to generate the set signal $U_{SET}$ 459 that can be a multi-bit signal to determines how much to adjust reference current source of the first LED driver circuit.

In one example, a counter circuit 441 is configured to receive a clock signal $U_{CLK}$ 449, a transition signal $U_T$ 418, and a reset signal $U_{RESET}$ 450. In the depicted example, the counter circuit 441 is utilized during the calibration phase to calibrate the output currents driven by the driver circuits to be substantially equal during normal operation. In one example, reset signal $U_{RESET}$ 450 may be asserted to initialize the counter circuit 441 to a starting value at the beginning of each calibration operation prior to determining the count value for count signal $U_{COUNT}$ 431. In one example, the transition signal $U_T$ 418 may be asserted to disable the counter circuit 441 from counting when a transition signal $U_T$ 418 is received.

In operation, the counter circuit 441 is configured to count at a rate determined by the clock signal $U_{CLK}$ 449 and output a count signal $U_{COUNT}$ 431 that has N-bits, where N represents the number of bits. In one example, the count signal $U_{COUNT}$ 431 can be incremented and/or decremented. An edge detection circuit 413 is configured to receive the calibration signal $U_C$ 416 and generate a transition signal $U_T$ 418 when the comparison circuit switches from a first state to a second state. As mentioned in FIG. 1, in one example if the first state of the calibration signal $U_C$ 416 is a logic high, the edge detection circuit 413 generates a transition signal $U_T$ 418 when the comparison circuit transitions such that the calibration signal $U_C$ 416 in a second state is a logic low. In another example, if the first state of the calibration signal $U_C$ 416 is a logic low, the edge detection circuit 413 generates a transition signal $U_T$ 418 when the comparison circuit 104 transitions such that the calibration signal $U_C$ 416 in a second state is a logic high.

In one example, when the transition signal $U_T$ 418 is generated, this indicates the reference signal $U_{LED1}$ 343 as shown in FIG. 3 is no longer less than the voltage signal $U_{LEDN}$ 344. In another example, the reference signal $U_{LED1}$ 343 as shown in FIG. 3 is no longer greater than the voltage signal $U_{LEDN}$ 344. The resulting count signal $U_{COUNT}$ 431 output value is saved and may then be received by a production tester circuit, such as production tester circuit 226 as shown in FIG. 2, which can then output the programming signal $U_{PR}$ 232 to the nonvolatile memory 225 as discussed. Thus, the count values stored in register 439 via the plurality of select signals $S_0$ 433 to $S_N$ 434 from a nonvolatile memory may be generated in response to the count values determined by the counter circuit in accordance with the teachings of the present invention.

In another example, the adjustment circuit 414 can program the register 439 without the use of an external production tester circuit and nonvolatile memory as described in FIG. 2. The adjustment circuit 414 can further include circuitry such as a state machine that is configured to receive the calibration signal $U_C$ 416, the transition signal $U_T$ 418, and the count signal $U_{COUNT}$ 431. In operation, the state machine can determine when a transition signal $U_T$ 418 is received, the counter circuit 441 stops counting. The count signal $U_{COUNT}$ 431 can be directly programmed into the register 439. In order to calibrate the next LED string, the state machine can assert a reset signal $U_{RESET}$ 450, and enable the counter circuit to begin counting.

Figure 5:
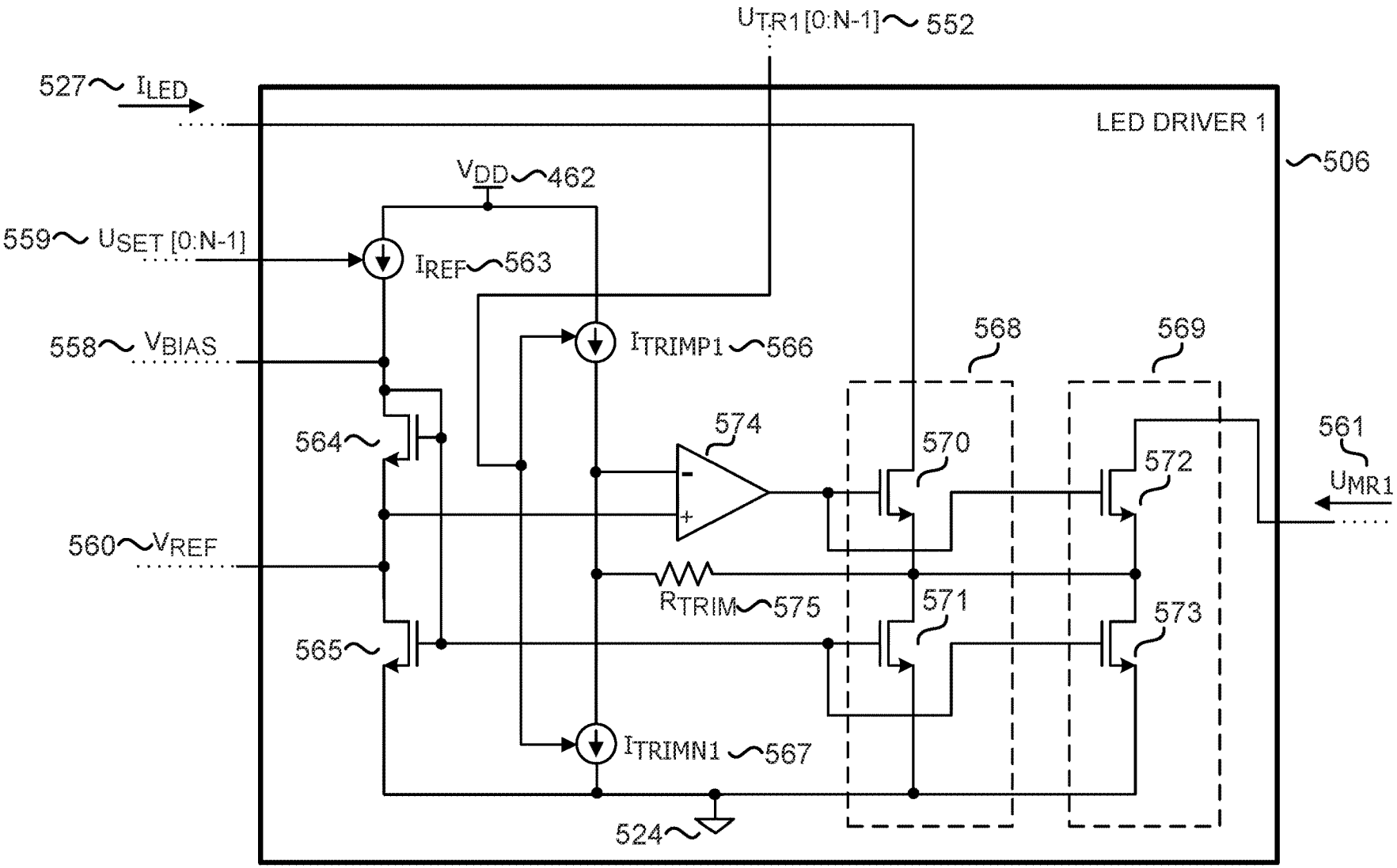
FIG. 5 is a block diagram illustrating one example of a first LED driver circuit included in a current matching circuit in accordance with the teachings of the present invention.

FIG. 5 is a block diagram illustrating one example of a LED driver 1 506 included in a current matching circuit in accordance with the teachings of the present invention. It is noted that the LED driver circuit 1 506 of FIG. 5 may be one example of the LED driver 1 circuit 106 of FIG. 1 or LED driver 1 306 of FIG. 3, and that similarly named and numbered elements referenced below are coupled and function similar to as described above. As shown in the depicted example, LED driver 1 506 includes a first cascode circuit 568 to be coupled to a reference load, such as for example a load such as a LED string 102 shown in FIG. 1, through which a reference output current $I_{LED}$ 527 is conducted. A first scaled cascode circuit 569 is coupled to the first cascode circuit 568. A scaled reference output current, also illustrated as current mirror signal $U_{MR1}$ 561, which is representative of the reference output current $I_{LED}$ 527 is conducted through the first scaled cascode circuit 569. In one example, scaled reference output current $U_{MR1}$ 561 conducted through the first scaled cascode circuit 569 is coupled to the current to voltage converter circuit, such as current to voltage converter circuit 337A shown in FIG. 3.

A first trimming current source $I_{TRIMP1}$ 566 is coupled to a second trimming current source $I_{TRIMN1}$ 567. A first trimming current conducted through the first and second trimming current sources $I_{TRIMP1}$ 566 and $I_{TRIMN1}$ 567 is configured to be responsive to a first trim signal $U_{TR1}$ 552 coupled to the first and second trimming current sources $I_{TRIMP1}$ 566 and $I_{TRIMN1}$ 567. In one example, the first trim signal $U_{TR1}$ 552 can be a multi-bit signal in which the most significant bit can turn on the first trimming current source $I_{TRIMP1}$ 566 or the second trimming current source $I_{TRIMN1}$ 567, while the remaining bits can determine how much current to provide. A first operational amplifier 574 includes a first input, such as for example an inverting input, that is coupled to an intermediate node between the first and second trimming current sources $I_{TRIMP1}$ 566 and $I_{TRIMN1}$ 567. The first operational amplifier 574 also includes a second input, such as for example a noninverting input, that is configured to receive a reference voltage $V_{REF}$ 560. The first operational amplifier 574 has an output that is coupled to first control terminals of the first cascode circuit 568 and the first scaled cascode circuit 569, such as for example the gate terminals of transistors 570 and 572 of the first cascode circuit 568 and the first scaled cascode circuit 569. In addition, second control terminals of the first cascode circuit 568 and the first scaled cascode circuit 569, such as for example the gate terminals of transistors 571 and 573 of the first cascode circuit 568 and the first scaled cascode circuit 569, are configured to receive a bias voltage $V_{BIAS}$ 558.

A first trim resistor $R_{TRIM}$ 575 includes a first end that is coupled to the intermediate node between the first and second trimming current sources $I_{TRIMP1}$ 566 and $I_{TRIMP2}$ 567. The first trim resistor $R_{TRIM}$ 575 also includes a second end that is coupled to an intermediate node of the first cascode circuit 568 and an intermediate node of the first scaled cascode circuit 569. For instance, as shown in the depicted example, the second end of first trim resistor $R_{TRIM}$ 575 is coupled to the intermediate node between transistors 570 and 571 of the first cascode circuit 568 and the intermediate node between transistors 572 and 573 of the first scaled cascode circuit 569.

A reference current source 563 is configured to conduct a reference current $I_{REF}$ in response to a set signal $U_{SET}$ 559. An external reference signal $I_{EXT}$ 394 as shown in FIG. 3 can be selected by a resistor (not shown). The value of the resistor sets $I_{EXT}$ 394 such that the full scale range of current is defined for the LED strings. In one example, the set signal $U_{SET}$ 559 can be a multi-bit signal that determines how much to adjust reference current source 563 for correct gain. A first transistor 564 is coupled to the reference current source 563 and is configured to conduct the reference current $I_{REF}$. The bias voltage $V_{BIAS}$ 558 is generated at an intermediate node between the reference current source 563 and the first transistor 564. The second transistor 565 is coupled to the first transistor 564 to conduct the reference current $I_{REF}$ such that the reference voltage $V_{REF}$ 560 is generated at an intermediate node between the first and second transistors 564 and 565. The source of transistor 565 is coupled to a local return 524.

In operation, the first LED driver circuit 506 calibrates output current $I_{LED}$ 527 in relation to a reference current source $I_{REF}$ 563. The set signal $U_{SET}$ 559 controls the reference current source $I_{REF}$ 563 to generate the bias voltage $V_{BIAS}$ 558. In order to regulate the output current $I_{LED}$ 527 of the first LED string, first operational amplifier 574 regulates the drain to source voltage of the transistor 571 to a second transistor 565. The first operational amplifier 574 receives reference voltage $V_{REF}$ 560 at the non-inverting input and the source voltage of the first cascode circuit 568 at the inverting input via first trim resistor $R_{TRIM}$ 575. The first operational amplifier 574 operates in a closed loop to make the voltage difference between the non-inverting and inverting inputs zero by increasing or decreasing its output voltage. The output of the operational amplifier controls the gate of transistor 570. In an ideal operational amplifier 574, there is no offset between its inputs. However in practice, there are some non-idealities, such that some offset can exist. First trim resistor $R_{TRIM}$ 575 is coupled between the inverting input of first operational amplifier 574 and first cascode circuit 568 in conjunction with current source $I_{TRIMP1}$ 566 or current source $I_{TRIMPN1}$ 567, the first operational amplifier 574 offset can be cancelled such that the voltage is accurately matched on drain of transistor 571 and transistor 573 to transistor 565.

Figure 6:
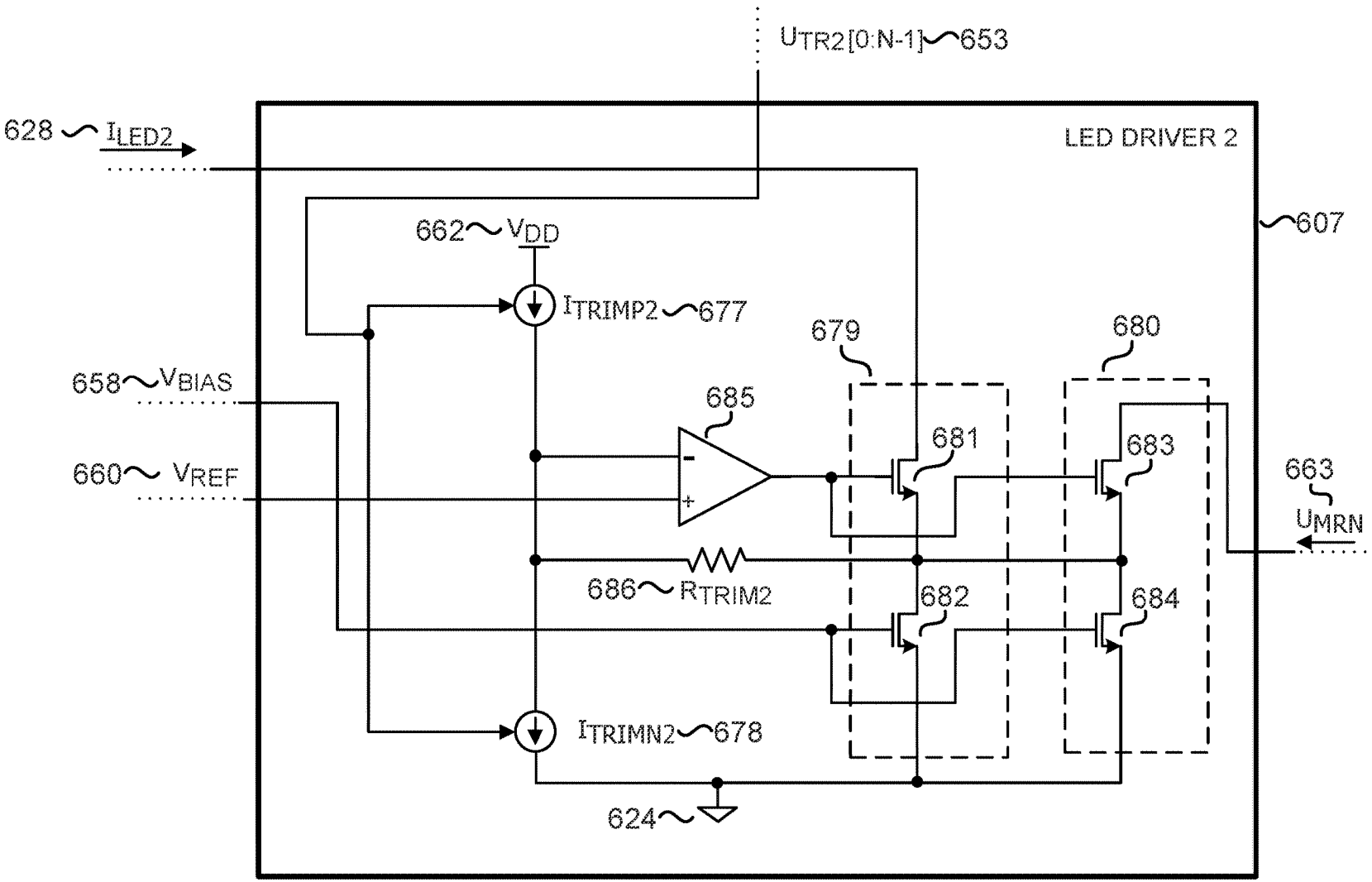
FIG. 6 is a block diagram illustrating one example of a second LED driver circuit included in a current matching circuit in accordance with the teachings of the present invention.

FIG. 6 is a block diagram illustrating one example of a second LED driver circuit 607 included in a current matching circuit in accordance with the teachings of the present invention. It is noted that the second LED driver circuit 607 of FIG. 6 may be one example of the second LED driver circuit 107 of FIG. 1 or second LED driver circuit 307 of FIG. 3, and that similarly named and numbered elements referenced below are coupled and function similar to as described above. As shown in the depicted example, second LED driver circuit 607 includes a second cascode circuit 679 that is configured to be coupled to a second load, such as for example, load 102 shown in FIG. 1, through which the second output current $I_{LED2}$ 628 is conducted. A second scaled cascode circuit 680 is coupled to the second cascode circuit 679. A second scaled output current, also illustrated as current mirror signal $U_{MRN}$ 663, which is representative of the second output current $I_{LED2}$ 628 is conducted through the second scaled cascode circuit 680. In one example, a second scaled output representative of the second scaled output current is conducted through the second scaled cascode circuit 680 and is coupled to the current to voltage converter circuit, such as current to voltage converter 337B shown in FIG. 3.

A third trimming current source $I_{TRIMP2}$ 677 is coupled to a fourth trimming current source $I_{TRIMN2}$ 678. The fourth trimming current source is configured to receive a supply voltage $V_{DD}$ 662. A second trimming current conducted through the third and fourth trimming current sources $I_{TRIMP2}$ 677 and $I_{TRIMN2}$ 678 is configured to be responsive to a second trim signal $U_{TR2}$ 653 coupled to the third and fourth trimming current sources $I_{TRIMP2}$ 677 and $I_{TRIMN2}$ 678. In one example, the second trim signal $U_{TR2}$ 653 can be a multi-bit signal in which the most significant bit can turn on the third trimming current source $I_{TRIMP2}$ 677 or the fourth trimming current source $I_{TRIMN2}$ 678, while the remaining bits can determine how much current to provide. A second operational amplifier 685 with an inverting input coupled to an intermediate node between the third and fourth trimming current sources $I_{TRIMP2}$ 677 and $I_{TRIMN2}$ 678. The second operational amplifier also includes a second input, such as for example a noninverting input, that is configured to receive a reference voltage $V_{REF}$ 660. In example, the reference voltage $V_{REF}$ 660 may be generated by the LED driver 1 506 of FIG. 5. The second operational amplifier has an output that is coupled to first control terminals of the second cascode circuit 679 and the second scaled cascode circuit 680, such as for example gate terminals of transistors 681 and 683 of the second cascode circuit 679 and the second scaled cascode circuit 680. In addition, second control terminals of the second cascode circuit 679 and the second scaled cascode circuit 680, such as for example the gate terminals of transistors 682 and 684 of the second cascode circuit 679 and the second scaled cascode circuit 680, are configured to receive the bias voltage $V_{BIAS}$ 658. The source terminal of transistor 682 is coupled to a local return 624.

A second trim resistor $R_{TRIM2}$ 686 includes a first end that is coupled to the intermediate node between the third and fourth trimming current sources $I_{TRIMP2}$ 677 and $I_{TRIMN2}$ 678. The second trim resistor $R_{TRIM2}$ 686 also includes a second end that coupled to an intermediate node of the second cascode circuit 679 and an intermediate node of the second scaled cascode circuit 680. For instance, as shown in the depicted example, the second end of second trim resistor $R_{TRIM2}$ 686 is coupled to the intermediate node between transistors 681 and 682 of the second cascode circuit 679 and the intermediate node between transistors 683 and 684 of the second scaled cascode circuit 680.

In the depicted example, the second operational amplifier 685 regulates the output current $I_{LED2}$ 628 through a second LED string to match the output current LED 527 through a first LED string. The bias voltage $V_{BIAS}$ 658 and the reference voltage $V_{REF}$ 660 are generated with respect to the first LED string, and are used as inputs for all of the subsequent or remaining LED strings in order for all of the output currents to be matched or to be substantially equal. The second operational amplifier 685 receives a reference voltage $V_{REF}$ 660 at the non-inverting input, and the drain voltage of the transistor 682 of second cascode circuit 679 at the inverting input via trim resistor $R_{TRIM2}$ 686. The second operational amplifier 685 operates in a closed loop to make the voltage difference between the non-inverting and inverting inputs zero by increasing or decreasing its output voltage. The output of the second operational amplifier 685 controls the gate of the transistor 681. In an ideal second operational amplifier 685, there is no offset between its inputs. However in practice, however, there are some non-idealities, such that some offset can exist. Second trim resistor $R_{TRIM2}$ 686 is connected between the inverting input of second operational amplifier 685 and second cascode circuit 679 in conjunction with current source $I_{TRIMP1}$ 677 or current source $I_{TRIMN2}$ 678. The second operational amplifier 685 offset can be cancelled such that the voltage is accurately matched on drain of transistors 682, 684 with that of transistor 565 in FIG. 5.

Figure 7:
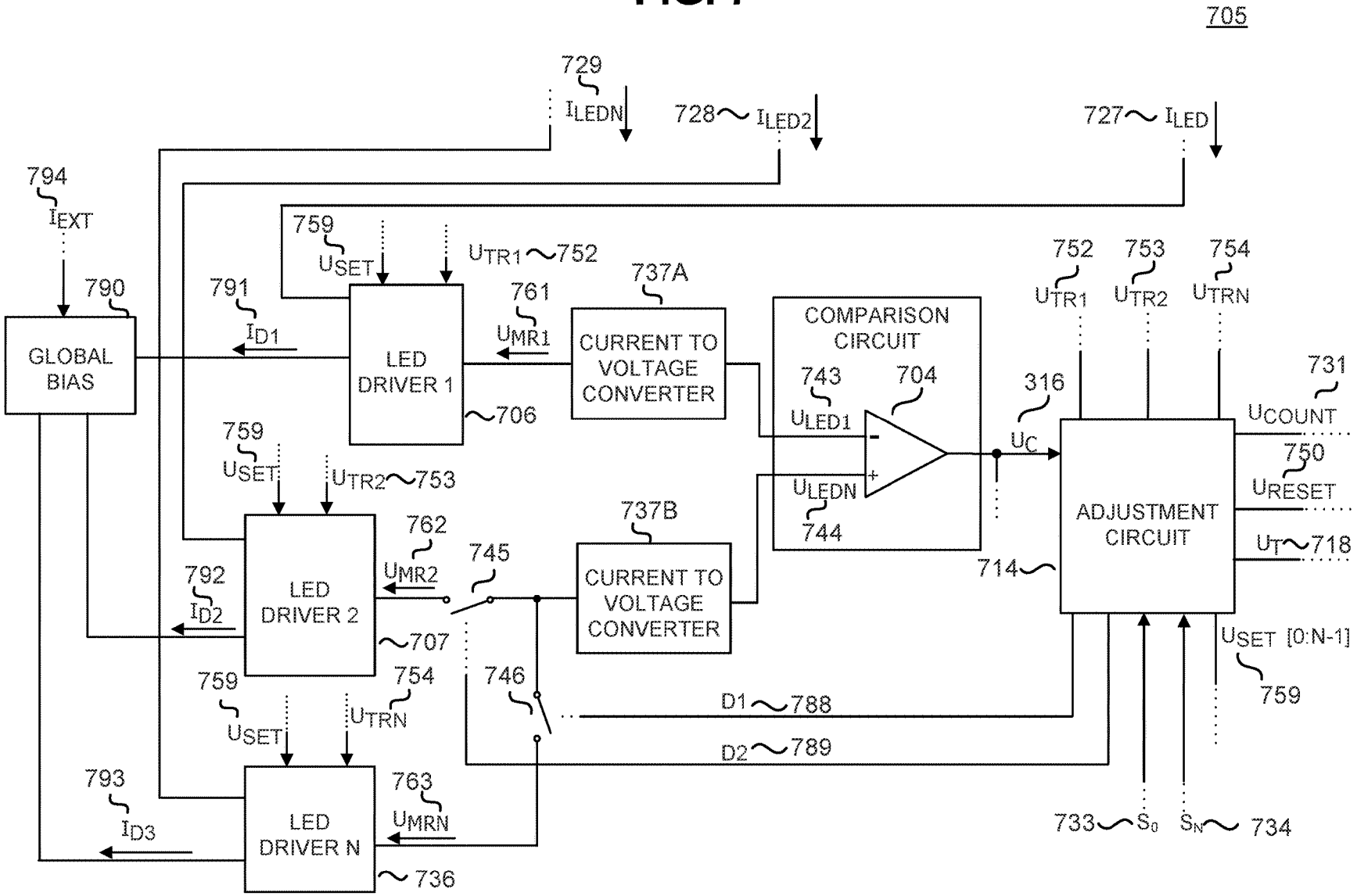
FIG. 7 is a block diagram illustrating another example of a current matching circuit with a global bias circuit in accordance with the teachings of the present invention.

FIG. 7 is a block diagram illustrating another example of a current matching circuit 705 with a global bias circuit in accordance with the teachings of the present invention. It is noted that the current matching circuit 705 of FIG. 7 may be one example of the current matching circuit 105 of FIG. 1 or of the current matching circuit 205 of FIG. 2, or of the current matching circuit 305, and that similarly named and numbered elements referenced below are coupled and function similar to as described above.

In FIG. 3, LED driver 1 303 generates both a reference voltage $V_{REF}$ 360 and a bias voltage $V_{BIAS}$ 358 used to connect all the LED drivers as voltages with respect to ground. However, the ground of LED driver 1 may be different than the ground of LED driver 2 and LED driver 3. The current matching circuit 705 may not be immune to the effects of ground bounce and noise that can cause a local variation of reference voltage $V_{REF}$ 360 and bias voltage $V_{BIAS}$ 358 seen by each driver. As a result, the currents of the LED strings no longer would match. To address ground bounce and possible noise issues, the current matching circuit 705 includes a global bias circuit 790 that can enable independent control of the gains of LED driver 1 706, LED driver 2 707, and LED driver N 736. The global bias circuit 790 is coupled to the plurality of the LED driver circuits. The global bias circuit 790 is configured to receive an external reference signal $I_{EXT}$ 794 selected by an external resistor (not shown). The global bias circuit is further configured to generate a first bias signal $I_{D1}$ 791, a second bias signal $I_{D2}$ 792, and a third bias signal $I_{D3}$ 793. The first bias signal $I_{D1}$ 791, second bias signal $I_{D2}$ 792, and third bias signal $I_{D3}$ 793 are current signals that would mitigate the effects of any ground bounce when compared to using a voltage reference. The value of the resistor sets the reference signal $I_{EXT}$ 794 such that the full scale range of current is defined for the LED strings.

Figure 8:
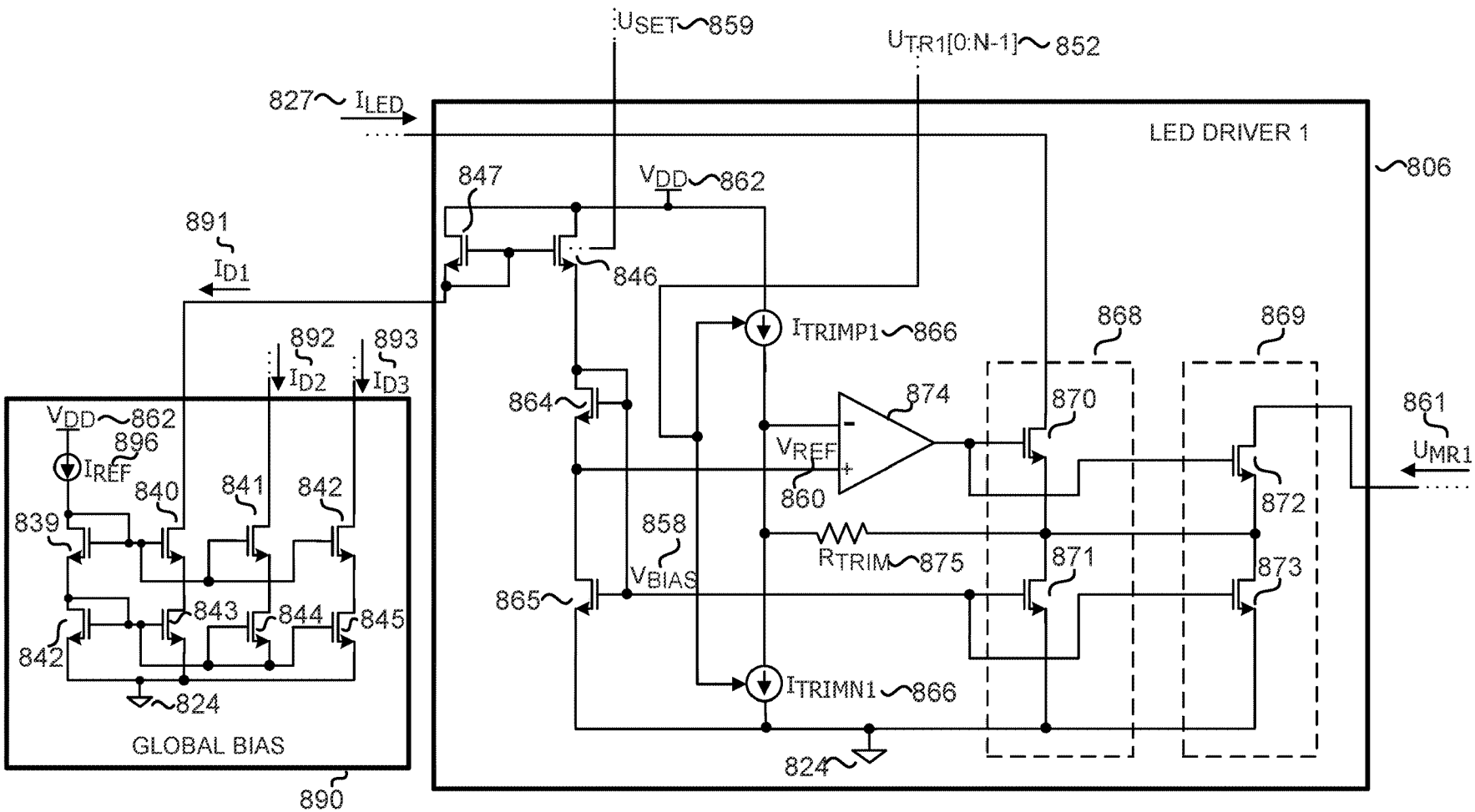
FIG. 8 is a block diagram illustrating one example of a first LED driver circuit included in a current matching circuit with a global bias circuit in accordance with the teachings of the present invention.

FIG. 8 is a block diagram illustrating one example of a LED driver 1 806 and a global bias circuit included in a current matching circuit in accordance with the teachings of the present invention. It is noted that the LED driver 1 806 of FIG. 8 may be one example of the first LED driver circuit 106 of FIG. 1 or LED driver 1 circuit 306 of FIG. 3, or the LED driver 1 circuit 506 of FIG. 5. In addition, it is noted the global circuit of FIG. 8 may be one example of the global bias circuit 790 of FIG. 7 and that similarly named and numbered elements referenced below are coupled and function similar to as described above.

The LED driver 1 806 is configured to receive a first bias signal $I_{D1}$ 891 generated by the global bias circuit 890. The global bias circuit 890 includes a current source $I_{REF}$ 896, and transistors 839, 840, 841, 842, 843, 844, 845. The current source $I_{REF}$ 896 selected is in response to the reference signal $I_{EXT}$ 794 of FIG. 7. As shown, transistors 839 and 840 and transistors 842 and 843 form a current mirror. Transistors 840 and 843, transistors 841 and 844, 842 and 845 are all coupled in cascode. Furthermore, the gate terminal of transistors 839 and 840 are coupled to the gate terminals of transistors 841 and 842. Likewise, the gate terminal of transistors 842 and 843 are coupled to the gate terminals of transistors 844 and 845. The drain terminal of transistor 840 provides the first bias signal $I_{D1}$ 891 to the first driver circuit. The drain terminal of transistor 841 provides the second bias signal $I_{D2}$ 892 to the second LED driver circuit. The drain terminal of transistor 842 provides the third bias signal $I_{D3}$ 893 the driver n circuit.

Previously in FIG. 3, the set signal $U_{SET}$ 359 determines how much to adjust reference current source that is later used to generate the bias voltage and the reference voltage.

As mentioned in FIG. 7, ground bounce and noise between drivers can cause variation of the bias voltage and the reference voltage 360 with respect to LED driver 1 such that the relative matching of the LED strings is no longer matched. To mitigate ground bounce and noise between the drivers, the first LED driver circuit 806 receives the first bias signal $I_{D1}$ 891 to locally generate the reference voltage $V_{REF}$ 860 and bias voltage $V_{BIAS}$ 858. First driver circuit includes a transistor 846, and 847, the source of transistor 847 is coupled to the gate terminal of transistor 846 and 847. Furthermore, the drain terminal of transistor 840 from the global bias circuit 890 is coupled to the source terminal of transistor 847 of the first LED driver circuit.

A first transistor 864 is coupled to transistor 846. The bias voltage $V_{BIAS}$ 858 is generated at an intermediate node between the transistor 846 and the first transistor 864. The second transistor 865 is coupled to the first transistor 864 such that the reference voltage $V_{REF}$ 860 is generated locally at an intermediate node between the first and second transistor 864 and 865. The transistor 846 is further configured to be adjustable by a set signal $U_{SET}$ 859. After the bias voltage $V_{BIAS}$ 858 and the reference voltage $V_{REF}$ 860 are generated, first LED driver circuit 806 operates in the same manner as described in the previous figures.

Figure 9:
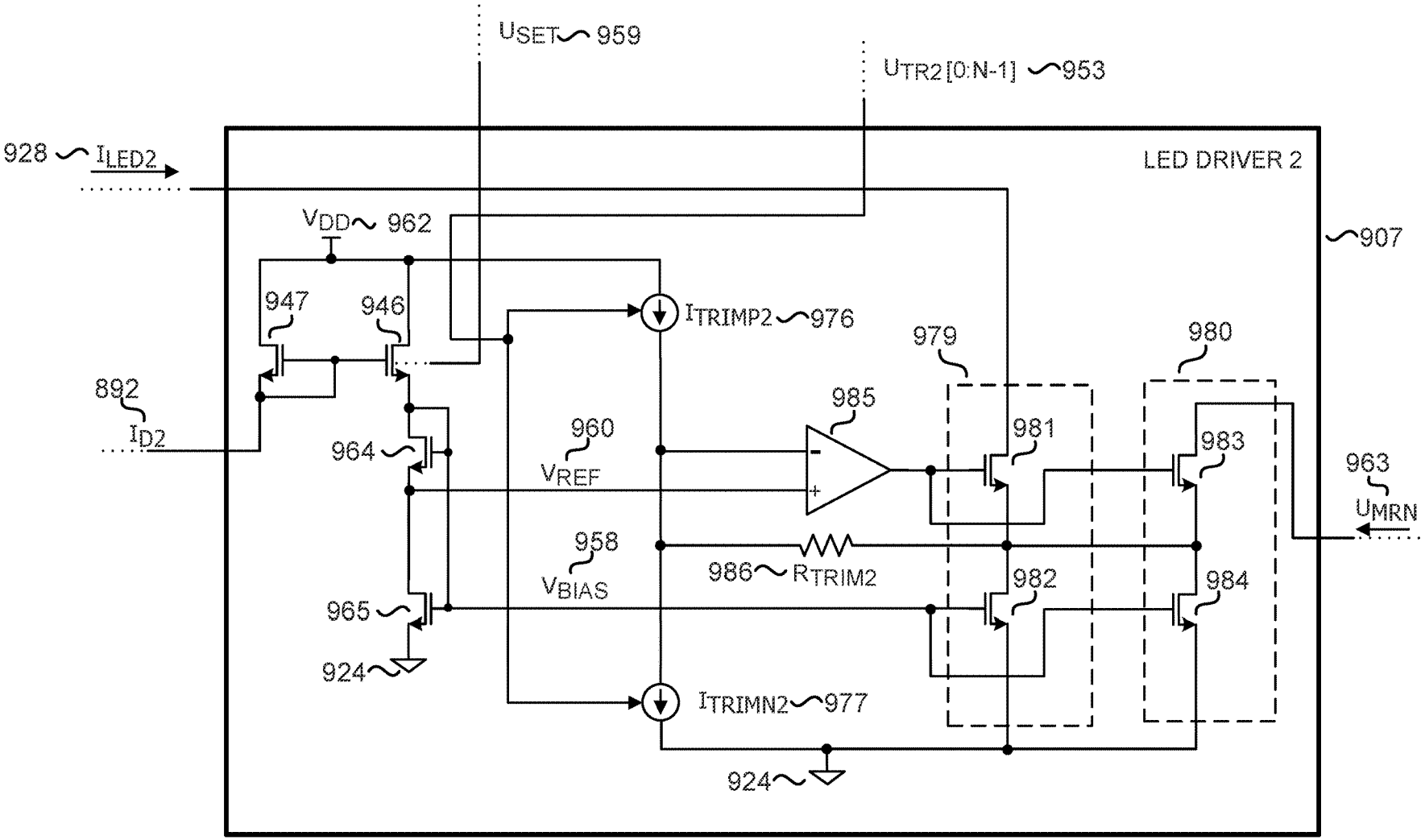
FIG. 9 is a block diagram illustrating another example of a second LED driver circuit included in a current matching circuit in accordance with the teachings of the present invention.

FIG. 9 is a block diagram illustrating one example of a LED driver 2 907 included in a current matching circuit in accordance with the teachings of the present invention. It is noted that the LED driver 2 907 of FIG. 9 may be one example of the second LED driver circuit 107 of FIG. 1 or LED driver 2 307 of FIG. 3, or LED driver 2 of FIG. 6, and that similarly named and numbered elements referenced below are coupled and function similar to as described above. In addition, the description of LED driver 2 907 can also be applied to LED driver N, where N is representative of the number of driver circuits.

Previously in FIG. 6, the LED driver 2 907 is configured to receive the bias voltage and the reference voltage from LED driver 1. As mentioned in FIGS. 7 and 8, ground bounce and noise between drivers can cause bias voltage and the reference voltage variation with respect to LED Driver 1 such that the relative matching of the LED strings is no longer matched. To mitigate ground bounce and noise between the LED drivers, LED 2 driver 907 is configured to receive the second bias signal $I_{D2}$ 892 to locally generate the reference voltage $V_{REF}$ 960 and bias voltage $V_{BIAS}$ 958.

LED driver 2 907 includes transistor 946, and 947. The source of transistor 947 is coupled to the gate terminal transistor 946 and 947. Furthermore, the drain terminal of transistor 841 from the global bias circuit 890 is coupled to the source terminal of transistor 947 of the LED driver 2 907.

A first transistor 964 is coupled to transistor 946. The bias voltage $V_{BIAS}$ 958 is generated at an intermediate node between the transistor 946 and the first transistor 964. The second transistor 965 is coupled to the first transistor 964 such that the reference voltage $V_{REF}$ 960 is generated locally at an intermediate node between the first and second transistor 964 and 965. The transistor 946 is further configured to be adjustable by a set signal $U_{SET}$ 959. After the bias voltage $V_{BIAS}$ 958 and the reference voltage $V_{REF}$ 960 are generated, LED driver 2 907 operates in the same manner as described in the previous figures.

Figure 10:
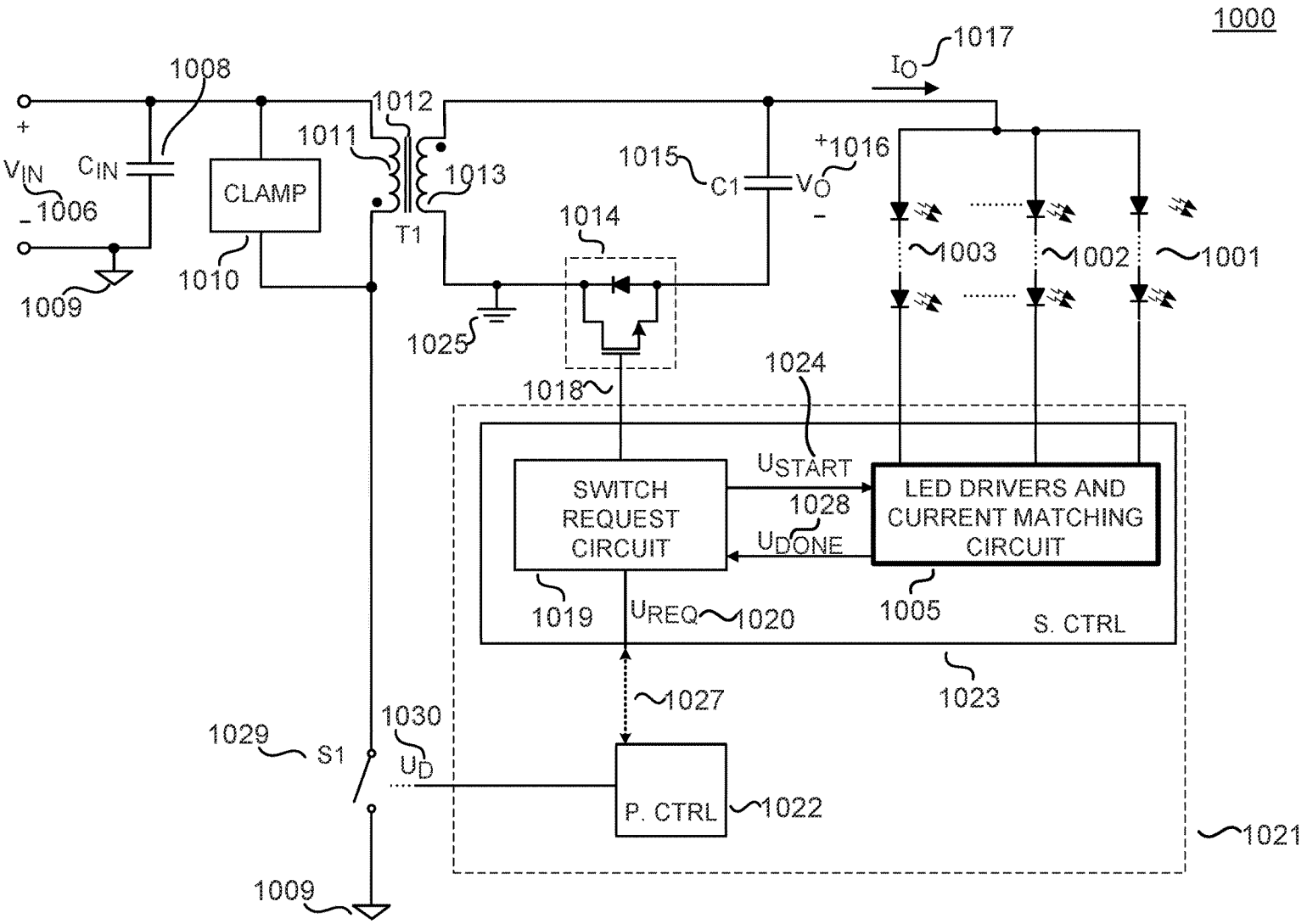
FIG. 10 illustrates one example of a power converter with a controller that provides power to a load and can calibrate LED loads in accordance with the teachings of the present invention.

FIG. 10 illustrates one example of a power converter with a controller that provides power to a load and can calibrate LED loads a power converter accordance with the teachings of the present invention. As shown in the depicted example, power converter 1000 includes an input configured to receive an input voltage 1006 across an input capacitor $C_{IN}$ 1008 that is coupled to an input return 1009. An energy transfer element 1012 is coupled between the input of the power converter 1000 and an output of the power converter 1000, which is coupled to a load that is coupled to an output return 1025. In one example, the load can be a plurality of loads such as LED strings 1001, 1002, and 1003. In the example, the output return 1025 at the output of the power converter 1000 is galvanically isolated from the input return 1009 at the input of the power converter. As such, there is no dc current between the input of the power converter 1000 and the output of the power converter 1000. The energy transfer element 1012 includes a primary winding 1011, which may also be referred to as an input winding, and a secondary winding 1013, which may also be referred to as an output winding. A clamp circuit 1010 is coupled across the primary winding 1011, and an output capacitor C1 1015 is coupled to the output of the power converter 1000 to provide an output voltage $V_O$ 1016 across the load. In addition, an output current $I_O$ 1017 is also provided to the load at the output of the power converter 1000.

In the example shown in FIG. 7, a power switch 1029 is coupled to the primary winding 1011 and the input return 1009 at the input of the power converter 1000. The power switch 1029 is configured to receive a drive signal $U_D$ 1030 generated by a primary control circuit 1022 to control switching of the power switch 1029 to control a transfer of energy from the input of the power converter 1000, through the energy transfer element 1012, to the output of the power converter 1000. The primary control circuit 1022 is included in a power converter controller 1021 that also includes a secondary control circuit 1023, which generates a request signal $U_{REQ}$ 1020 that may be received by the primary control circuit 1022 through a communication link 1027. In the example, the communication link 1027 maintains the galvanic isolation between the input of the power converter 1000 and the output of the power converter 1000.

As shown in the example of FIG. 10, the secondary controller circuit 1023 includes a switch request circuit 1019 that is configured to control the synchronous rectifier 1014 with a synchronous drive signal 1018. Furthermore, the switch request circuit 1019 generates a start signal $U_{START}$ 1024 in order to start the current matching circuit 1005 in order to calibrate the plurality of loads, in this case LED strings 1001, 1002, 1003. The operation of the current matching circuit is similar to what was described in the previous figures. In one example, the current matching circuit 1005 can generate a done signal $U_{DONE}$ 1028 when the output current through the plurality of LED loads 1001, 1002, and 1003 is substantially equal.

The above description of illustrated examples of the present invention, including what is described in the Abstract, are not intended to be exhaustive or to be limited to the precise forms disclosed. While specific embodiments of, and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

What is claimed is:

1. A current matching circuit, comprising:

N light emitting diode (LED) driver circuits, where N>1, each LED driver circuit having an output signal; and a comparison circuit coupled to the N LED driver circuits and configured to compare the N output signals; and an adjustment circuit coupled to the comparison circuit and the N LED driver circuits and configured to trim output currents of the N LED driver circuits to be substantially equal, wherein the output signal of one of the N LED driver circuits is a reference output current and the output currents of the other of the N LED driver circuits are trimmed in response to the reference output current.

2. The current matching circuit of claim 1, wherein the comparison circuit is configured to compare the N output signals according to an output characteristic selected from a group comprising current and voltage.

3. The current matching circuit of claim 2, further comprising:

a current to voltage converter circuit coupled to receive the N output signals and configured to output N voltage signals; and the adjustment circuit comprises, a selection circuit coupled to the current to voltage converter circuit and configured to select which one of the other of the N output signals is compared to the reference voltage signal, a counter circuit configured to generate count values in response to a clock signal, an edge detection circuit coupled to the comparison circuit, wherein the edge detection circuit is configured to generate a transition signal in response to the comparison circuit transitioning from a first state to a second state, and a register configured to store count values to trim the N LED driver circuits and generate a plurality of trim signals that correspond to the count values stored in the register wherein respective ones of the plurality of trim signals trims a respective output current through the N LED driver circuits such that the output currents are substantially equal.

4. The current matching circuit of claim 3, wherein a first of the N LED driver circuits comprises:

a first cascode circuit coupled to a reference load through which the reference output current is conducted; and a first scaled cascode circuit coupled to the first cascode circuit, wherein a scaled reference output current representative of the reference output current is conducted through the first scaled cascode circuit, and wherein the first scaled cascode circuit is coupled to the current to voltage converter circuit.

5. The current matching circuit of claim 4, wherein the first of the N LED driver circuits further comprises:

a first trimming current source and a second trimming current source coupled to conduct a first trimming current through the first and second trimming current sources wherein the first trimming current is responsive to a first trim signal that is coupled to the first and second trimming current sources; and a first operational amplifier having a first input coupled to an intermediate node between the first and second trimming current sources, wherein the first operational amplifier has a second input coupled to receive a reference voltage, wherein the first operational amplifier has an output coupled to first control terminals of the first cascode circuit and the first scaled cascode circuit, and wherein second control terminals of the first cascode circuit and the first scaled cascode circuit are coupled to receive a bias voltage.

6. The current matching circuit of claim 5, wherein the first of the N LED driver circuits further comprises a first trim resistor having a first end coupled to the intermediate node between the first and second trimming current sources, wherein the first trim resistor has a second end coupled to an intermediate node of the first cascode circuit and an intermediate node of the first scaled cascode circuit.

7. The current matching circuit of claim 5, wherein the first of the N LED driver circuits further comprises:

a reference current source configured to conduct a reference current in response to a set signal;

a first transistor coupled to the reference current source to conduct the reference current, wherein the bias voltage is generated at an intermediate node between the reference current source and the first transistor; and a second transistor coupled to the first transistor to conduct the reference current, wherein the reference voltage is generated at an intermediate node between the first and second transistors.

8. The current matching circuit of claim 2, wherein each of the other N LED driver circuits comprises:

a cascode circuit coupled to a load through which the output current is conducted; and a scaled cascode circuit coupled to the cascode circuit and configured to conduct a scaled output current representative of the output current through the scaled cascode circuit, wherein the scaled cascode circuit is coupled to the current to voltage converter circuit.

9. The current matching circuit of claim 8, wherein each of the other N LED driver circuits further comprises:

a third trimming current source and a fourth trimming current source coupled to conduct a second trimming current through the third and fourth trimming current sources, wherein the second trimming current is responsive to a second trim signal coupled to the third and fourth trimming current sources; and a second operational amplifier having a first input coupled to receive a bias voltage generated by the first LED driver circuit and coupled to an intermediate node between the third and fourth trimming current sources, wherein the second operational amplifier has a second input coupled to receive a reference voltage generated by the first LED driver circuit, wherein the second operational amplifier has an output coupled to first control terminals of the second cascode circuit and the second scaled cascode circuit, and wherein second control terminals of the second cascode circuit and the second scaled cascode circuit are coupled to receive the bias voltage.

10. The current matching circuit of claim 9, wherein each of the N LED driver circuits further comprises a second trim resistor having a first end coupled to the intermediate node between the third and fourth trimming current sources, wherein the second trim resistor has a second end coupled to an intermediate node of the second cascode circuit and an intermediate node of the second scaled cascode circuit.

11. The current matching circuit of claim 1, wherein N light emitting diode (LED) loads are coupled to the N LED driver circuits such that each respective output current through the N LED loads is substantially equal.

12. The current matching circuit of claim 1, further comprising a global bias circuit coupled to the N LED driver circuits, the global bias circuit configured to generate a first bias signal, a second bias signal, and a third bias signal in response to an external reference signal to individually adjust a gain of the N LED driver circuits.

* * * * *